US005292781A

United States Patent [19]

Floyd

[11] Patent Number: 5,292,781

[45] Date of Patent: Mar. 8, 1994

[54] PAPER COATING COMPOSITION

[75] Inventor: William C. Floyd, Chester, S.C.

[73] Assignee: Sequa Chemicals, Inc., Chester, S.C.

[21] Appl. No.: 927,058

[22] Filed: Aug. 6, 1992

[51] Int. Cl.[5] ..... B05D 5/04; C08L 3/02; C08L 89/00

[52] U.S. Cl. ..... 524/17; 524/47; 524/417; 427/411

[58] Field of Search ..... 524/47, 51, 17, 417; 427/41

[56] References Cited

U.S. PATENT DOCUMENTS

| | | | |
|---|---|---|---|
| 2,652,374 | 9/1953 | Thompson | 524/47 |
| 2,699,432 | 1/1955 | Marra et al. | 523/310 |
| 2,801,242 | 6/1957 | Kerr et al. | 536/106 |
| 2,852,393 | 9/1958 | Kerr et al. | 426/578 |
| 2,884,412 | 4/1959 | Neukom | 536/109 |
| 2,884,413 | 4/1959 | Kerr et al. | 536/106 |
| 2,938,901 | 5/1960 | Kerr et al. | 536/106 |
| 3,024,212 | 3/1962 | Paschall et al. | 524/47 |
| 3,132,066 | 5/1964 | Kerr et al. | 162/175 |
| 3,144,298 | 8/1964 | Hullinger et al. | 8/115.6 |
| 3,553,195 | 1/1971 | Jarowenko | 536/106 |
| 3,591,412 | 7/1971 | Smit | 428/452 |
| 3,682,733 | 8/1972 | Smit | 428/452 |
| 3,719,514 | 3/1973 | Taylor | 524/47 |
| 3,778,280 | 12/1973 | Dittrich | 106/1 |
| 3,957,710 | 5/1976 | Rohmann et al. | 427/411 |
| 4,123,593 | 10/1978 | Dorr et al. | 428/535 |
| 4,139,505 | 2/1979 | Rogols et al. | 524/47 |
| 4,566,910 | 1/1986 | Hubbard et al. | 127/70 |
| 4,652,471 | 3/1987 | van Rooden et al. | 427/411 |
| 4,762,868 | 8/1988 | Wright | 427/411 |
| 4,837,087 | 6/1989 | Floyd et al. | 428/511 |

OTHER PUBLICATIONS

R. M. Hamilton et al., "Production and Uses of Starch Phosphates", Starch: Chemistry And Technology (vol. II-Industrial Aspects), 1967; Academic Press pp. 361-368.

*Primary Examiner*—John Kight, III
*Assistant Examiner*—Jeffrey Culpeper Mullis
*Attorney, Agent, or Firm*—Mitchell D. Bittman

[57] ABSTRACT

A paper coating composition is provided comprising pigment, binder and a cyclic phosphate salt as an insolubilizer for the binder.

11 Claims, No Drawings

PAPER COATING COMPOSITION

BACKGROUND OF THE INVENTION

This invention relates to a paper coating composition, more particularly to a cyclic phosphate salt which is added to insolubilize the binder in the paper coating.

Paper coating compositions are generally a fluid suspension of pigment, such as clay with or without titanium dioxide, calcium carbonate, or the like, in an aqueous medium which includes a binder such as starch, modified starch, polyvinyl alcohol, polymers, or protein to adhere the pigment to paper.

The hydrophilic nature of the binder requires the presence of an insolubilizing material which crosslinks the binder upon curing of the coated paper, making it hydrophobic and thus improving the off-set printing characteristics of the surface of the coated paper. The most widely used crosslinking materials are glyoxal resins and formaldehyde-donor agents such as melamine-formaldehyde, urea-melamine-formaldehyde, and partially or wholly methylated derivatives thereof. While these systems are effective, alternative systems are sometimes needed as glyoxal resins are highly reactive and tend to build viscosity and the melamine-formaldehyde resins have an unpleasant odor and release free formaldehyde.

The reaction of various phosphates with binders for use in a variety of applications has been disclosed in the literature. Sodium trimetaphosphate (STMP) has long been used in the detergent industry and the food starch industry. STMP has been used to crosslink granular starch in food use applications such as puddings or pie fillings and has also been used as a wet end additive and a sizepress or water box additive in the paper industry to obtain wet strength. U.S. Pat. No. 2,884,412 discloses preparing a starch phosphate by reacting starch with sodium, potassium or lithium phosphate and using the starch phosphate as a sizing agent in the surface finishing of paper, as a thickening agent in food products, etc. U.S. Pat. No. 3,591,412 discloses coating paper with a pigment and a binder consisting of a depolymerized starch phosphate ester. U.S. Pat. No. 2,699,432 discloses a paper coating composition containing pigment, an alkali metal silicate, latex or starch and tetrasodium pyrophosphate. U.S. Pat. No. 2,801,242 discloses preparing distarch phosphate esters by reacting starch and a metaphosphate salt, with the product useful for pasting papers products, dusting surgeon's gloves, applying adhesives and sizes or in food products. However, these references do not disclose the use of a cyclic phosphate salt as an insolubilizer for binders in paper coating compositions, much less the improved control of coating viscosity and wet rub resistance obtained thereby.

SUMMARY OF THE INVENTION

Briefly, the paper coating composition comprises a pigment, binder and a cyclic phosphate salt as an insolubilizer for the binder.

DETAILED DESCRIPTION OF THE INVENTION

It has been found that certain phosphate compounds, namely cyclic phosphate salts such as the trimetaphosphate, tetrametaphosphate and hexametaphosphate salts when added as insolubilizers improves the water resistance of paper coating binders.

The advantage of the cyclic phosphate salts is that they readily react to form distarch phosphate esters upon curing of the coated paper, whereas other phosphates either do not react or do so reluctantly. The distarch phosphate esters form a crosslink bond in the starch. Other reactive phosphates, such as tetrasodium phosphate, do not crosslink. Various salts of the cyclic phosphates may be utilized provided they are soluble in water. The preferred salts are sodium and potassium, with the sodium salt highly preferred since it is readily available commercially.

The cyclic phosphate salts are useful as an insolubilizer for natural binders. The binders include, but are not limited to various starches including unmodified starch; oxidized starch; enzyme-converted starch; starches having functional groups such as hydroxyl, carboxyl, amido, and amino groups; proteins, such as casein; polyvinyl alcohols; and the like, and their mixtures. Through use of this insolubilizer, the coating composition containing natural binders are able to impart properties, such as gloss, strength, etc. which are closer to those imparted by latex binders, but at a fraction of the cost of latex binders.

The coating composition will generally contain pigments which may be clay with or without titanium dioxide and/or calcium carbonate, and the like, and mixtures thereof. In addition to the binder, the pigment material, and the additive described above, the paper coating composition may also include materials such as dispersants (e.g. tetrasodium pyrophosphate), lubricants (e.g. calcium stearate), viscosity modifiers (e.g. urea), defoamers (e.g. oil based emulsions or ethyl alcohol), preservatives, colored pigments, viscosity modifiers (e.g. carboxymethylcellulose), and the like, in conventional amounts, as well as a latex (e.g. a polymer such as a styrene-butadiene copolymer or acrylic polymer) which may be used as a binder in addition to the natural binders.

In the paper coating compositions described herein the amount of binder is based upon the amount of pigment with the ratio varying with the amount of bonding desired and with the adhesive characteristics of the particular binder employed. In general, the amount of binder is about 8 to 20 parts based on 100 parts by weight of the pigment. The amount of insolubilizer varies with the amount and properties of the binder and the amount of insolubilization desired. In general, the cyclic phosphate salt is added to about 1 to 15 percent, and preferably about 5 to 10 percent, based on the weight of the binder (solids or dry basis).

The coating composition of this invention can be applied to paper or paper-like substrates by any known and convenient means. Generally the pH of the coating composition will range from 5.5 to 11, but preferably 6 to 9. The coatings are then dried and cured to affect crosslinking of the binder by the cyclic phosphate salt insolubilizer to impart the desired water resistance to the coated paper. Generally, drying and curing are carried out at temperatures in the range of 180° to 250° F. Typically the coating composition in aqueous solution will have a solids content within the range of 30 to 80%, preferably 40 to 60%, depending upon the method of application and product requirements.

The invention is further illustrated but is not intended to be limited by the following Examples.

EXAMPLE I

A series of paper coating formulations were prepared, as outlined below (in parts by weight). This series consisted of a control with no insolubilizer, a control with a cyclic urea-glyoxal condensate as the insolubilizer, and three samples with sodium trimetaphosphate (STMP) at different pH levels. An additional sample was included with urea at pH nine (9) in combination with the STMP to test compatibility under these conditions. These conditions are known to be detrimental to the performance of glyoxal-based insolubilizers. The formulations at a solids level of 8% were applied to paper, dried at 220° F. on a drum dryer, calendared 3 nips at 400 PSI at 150° F. and tested for wet rub resistance.

| | Coating Formulations | | | | | |
|---|---|---|---|---|---|---|
| | 1 | 2 | 3 | 4 | 5 | 6 |
| No. 1 Clay | 52 | 52 | 52 | 52 | 52 | 52 |
| Delan Clay | 35 | 35 | 35 | 35 | 35 | 35 |
| Calcine Clay | 10 | 10 | 10 | 10 | 10 | 10 |
| Titanium dioxide | 3 | 3 | 3 | 3 | 3 | 3 |
| Dow 620 (styrene-butadiene latex) | 4 | 4 | 4 | 4 | 4 | 4 |
| PG 280 (ethylated starch) | 7 | 7 | 7 | 7 | 7 | 7 |
| Dispex N-40 (dispersant) | 0.2 | 0.2 | 0.2 | 0.2 | 0.2 | 0.2 |
| Sunkote 450 (calcium stearate lubricant) | 0.8 | 0.8 | 0.8 | 0.8 | 0.8 | 0.8 |
| Sodium Trimetaphosphate | | 0.28 | 0.28 | 0.28 | | 0.28 |
| Cyclic urea glyoxal condensate | | | | | 0.28 | |
| Urea | | | | | | 0.35 |
| pH | 7.0 | 7.0 | 8.0 | 9.0 | 7.0 | 9.0 |

| | Test Results | | | | | |
|---|---|---|---|---|---|---|
| Coating Formulation | 1 | 2 | 3 | 4 | 5 | 6 |
| Brookfield Visc. #3, initial | | | | | | |
| @ 20 rpm | 2350 | 2850 | 2950 | 3250 | 2450 | 3150 |
| @ 100 rpm | 830 | 1000 | 1030 | 1150 | 850 | 1060 |
| 4 hours | | | | | | |
| @ 20 rpm | 2500 | 3300 | 2700 | 3050 | 2650 | 3000 |
| @ 100 rpm | 860 | 1100 | 880 | 1100 | 1000 | 1000 |
| Adams Wet Rub residue, mg | 16.1 | 6.4 | 7.3 | 6.7 | 12.3 | 6.8 |

These results show that the coating formulations containing sodium trimetaphosphate had stable viscosities both initially and after 4 hours and the coated paper exhibited good wet rub resistance even under conditions detrimental to glyoxal based insolubilizers.

EXAMPLE II

Using the coating formulation as in Example I, other phosphorous compounds were tested as insolubilizers. The coating formulations were adjusted to pH 8.0 prior to coating. The insolubilizers were added at the same level as in Example I, applied, cured and tested as before.

| | Coating # | | | | | | |
|---|---|---|---|---|---|---|---|
| Insolubilizer | 1 | 2 | 3 | 4 | 5 | 6 | 7 |
| None | blank | | | | | | |
| Cyclic urea/glyoxal resin A | | 0.28 | | | | | |
| STMP | | | 0.28 | | | | |
| Sodium hexa-metaphosphate | | | | 0.28 | | | |
| Sodium hypophosphite | | | | | 0.28 | | |
| Sodium phosphate, mono basic | | | | | | 0.28 | |
| Cyclic urea-glyoxal resin B | | | | | | | 0.28 |

| | Test Results | | | | | | |
|---|---|---|---|---|---|---|---|
| Coating # | 1 | 2 | 3 | 4 | 5 | 6 | 7 |
| Brookfield Visc. #3 cps, initial | | | | | | | |
| @ 20 rpm | 3200 | 3040 | 3200 | 2100 | 3500 | 3600 | 3000 |
| @ 100 rpm | 1160 | 1080 | 1160 | 1120 | 1200 | 1280 | 1040 |
| 4 hours | | | | | | | |
| @ 20 rpm | 3200 | 3400 | 3800 | 3400 | 4700 | 4000 | 3800 |
| @ 100 rpm | 1120 | 1180 | 1320 | 1180 | 1580 | 1380 | 1280 |
| Adams Wet Rub % T (10 sec.) | 73.1 | 86.5 | 78.4 | 77.7 | 71.6 | 71.4 | 84.7 |

These results show that the cyclic phosphates (3 and 4) provide both a good coating viscosity and wet rub resistance. The non-cyclic phosphates (5 and 6) show an increased viscosity rise and make the coating more sensitive to water than the blank (1).

EXAMPLE III

A protein paper coating was prepared by the following formulation and applied to paper with a trailing blade coater. The control was a commercially available stabilized ammonium zirconium carbonate (AZC) solution which is widely used to insolubilize protein in such formulations. The STMP was used at two levels to gauge effectiveness. The coatings and coated paper were tested with the following results:

| | Coating Formulations | | |
|---|---|---|---|
| | 1 | 2 | 3 |
| #1 Clay | 100 | 100 | 100 |
| Procote 400 (soy protein) | 7 | 7 | 7 |
| Dispex N-40 (dispersant) | 0.15 | 0.15 | 0.15 |
| AZC (20% as ZrO) | 0.56 | | |
| STMP | | 0.21 | 0.56 |
| Solids | 54.3 | 54.2 | 54.2 |
| pH | 9.2 | 9.4 | 9.4 |

| | Results | | |
|---|---|---|---|
| | 1 | 2 | 3 |
| Brookfield Visc. #3, initial | | | |
| @ 20 rpm | 4700 | 5400 | 6650 |
| @ 100 rpm | 1730 | 1980 | 2340 |
| 4 hours | | | |
| @ 20 rpm | 4900 | 7150 | 7500 |
| @ 100 rpm | 1900 | 2340 | 2540 |
| Adams Wet Rug, mg | 6.3 | 11.0 | 6.5 |

-continued

| | Results | | |
|---|---|---|---|
| | 1 | 2 | 3 |
| Hercules Sizing Test, sec | 388.6 | 332.4 | 370.2 |

These results show that STMP gives comparable performance on an equal activity basis. It has considerable economic advantage over zirconium insolubilizers.

What is claimed is:

1. Paper coating composition comprising by weight 100 parts of a pigment, about 8 to 20 parts by weight of a binder effective to bind the pigment selected from the group consisting of starch, polyvinyl alcohol, protein and their mixtures, and as an insolubilizer for the binder, a cyclic phosphate salt at a level of about 1 to 15% based on the weight of the binder, wherein the cyclic phosphate salt is selected from the group consisting of trimetaphosphate salt, tetrametaphosphate salt and hexametaphosphate salt or mixtures thereof.

2. Composition of claim 1 wherein the cyclic phosphate salt is trimetaphosphate salt.

3. Composition of claim 2 wherein the salt is sodium or potassium.

4. Composition of claim 2 wherein the binder is starch.

5. Composition of claim 1 comprising 5 to 10% of cyclic phosphate salt based on the weight of the binder.

6. Composition of claim 1 wherein the salt is sodium.

7. Composition of claim 1 further comprising a latex binder.

8. Composition of claim 1 further comprising calcium stearate.

9. Composition of claim 1 wherein the coating composition in aqueous solution has a solids content of 30 to 80% and a pH of 5.5 to 11.

10. Composition of claim 8 wherein the solids content, is 40 to 60% and the pH 6 to 9.

11. Process of coating paper comprising applying the composition as in claims 1, 3, or 6 to a paper, followed by drying and curing the coated paper.

* * * * *